US005385425A

United States Patent [19]

Hayes

[11] Patent Number: 5,385,425

[45] Date of Patent: Jan. 31, 1995

[54] APPARATUS AND METHOD FOR REPAIR OF ROADWAY

[76] Inventor: Randall A. Hayes, P.O. Box 159, Betsy Layne, Ky. 41605

[21] Appl. No.: 265,681

[22] Filed: Jun. 24, 1994

Related U.S. Application Data

[63] Continuation of Ser. No. 818,882, Jan. 10, 1992, abandoned.

[51] Int. Cl.[6] ..... E01C 11/16; E01C 23/04

[52] U.S. Cl. ..... 404/72; 404/85; 405/232

[58] Field of Search ..... 404/72, 85; 405/232, 405/262; 173/28; 37/189, 181

[56] References Cited

U.S. PATENT DOCUMENTS

| | | | |
|---|---|---|---|
| 2,705,379 | 4/1955 | Fruhling | 37/81 |
| 2,820,556 | 1/1958 | Davis . | |
| 3,447,613 | 6/1969 | Lisenby | 173/28 |
| 3,536,218 | 10/1970 | Guinot . | |
| 3,696,625 | 10/1972 | Alexander . | |
| 3,756,330 | 9/1973 | Russell, Jr. . | |
| 3,851,776 | 12/1974 | Leyrat . | |
| 3,965,628 | 6/1976 | Loftis . | |
| 4,627,499 | 12/1986 | Magee et al. . | |
| 4,697,648 | 10/1987 | Brandt | 175/28 X |
| 4,734,006 | 3/1988 | Krob et al. . | |
| 4,773,814 | 9/1988 | Brocklebank et al. . | |
| 4,809,788 | 3/1989 | Nelson . | |
| 4,826,359 | 5/1989 | Bec et al. | 405/271 |

*Primary Examiner*—William P. Neuder

*Attorney, Agent, or Firm*—Dickinson, Wright Moon, Van Dusen & Freeman

[57] ABSTRACT

A device for repair of a roadway embankment includes a movable base which is capable of being driven on a two-lane roadway. A platform is mounted on the base and is rotatable with respect to the base about a generally vertical axis. A drilling rig is mounted on one end of the platform for drilling a hole for receiving an elongate reinforcing rail, and a power unit is mounted at an opposite end of the platform for generating power for the drilling rig and for counterbalancing the weight of the drilling rig. The drilling rig includes a drilling bit and a compressor for generating a flow of air to remove the drilling cuttings. The length of the platform is such that the distance between the centerline of the drilling bit and the outer side of the closest supporting wheel allows the base to be located on a undamaged roadway and the drilling bit operated to drill a hole for receiving the reinforcing rail in the damaged portion.

11 Claims, 1 Drawing Sheet

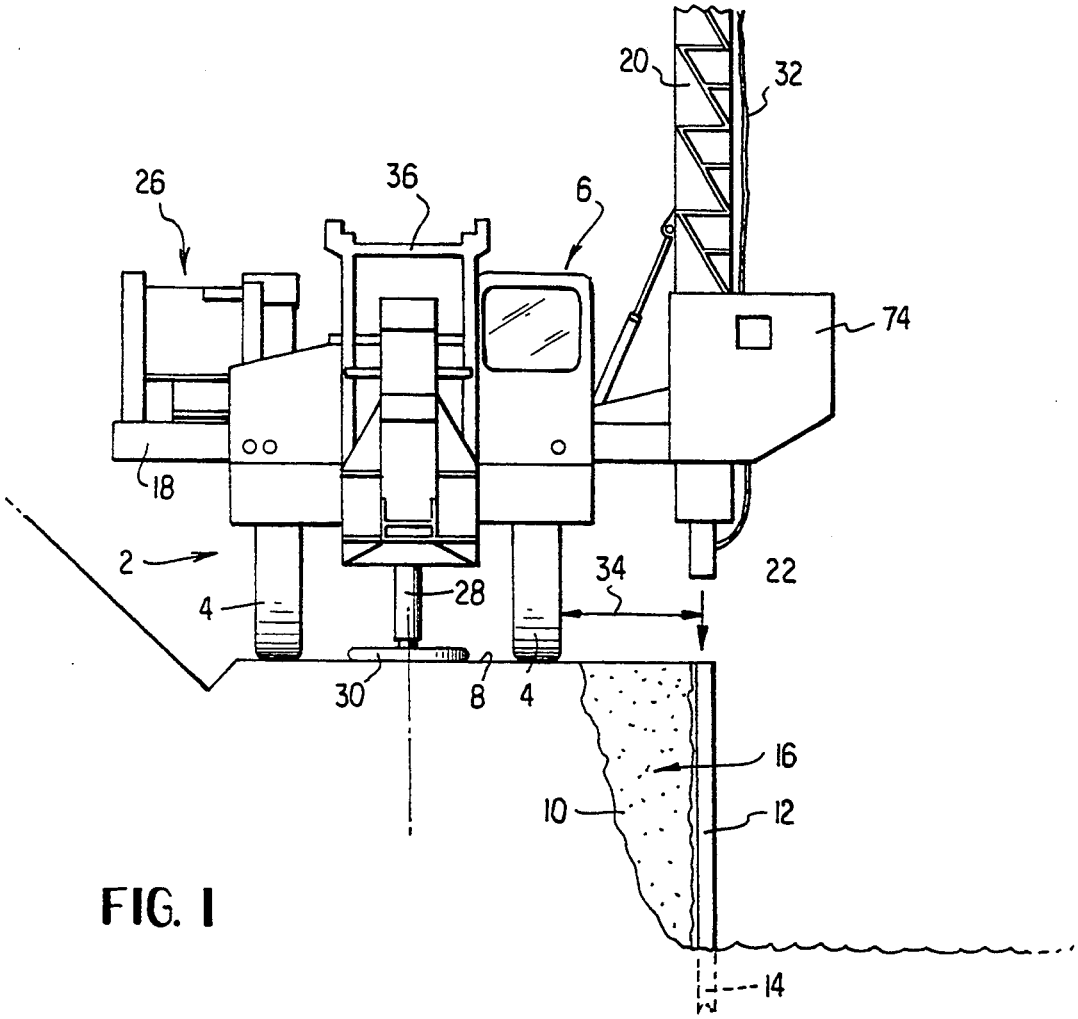
FIG. 1
FIG. 2
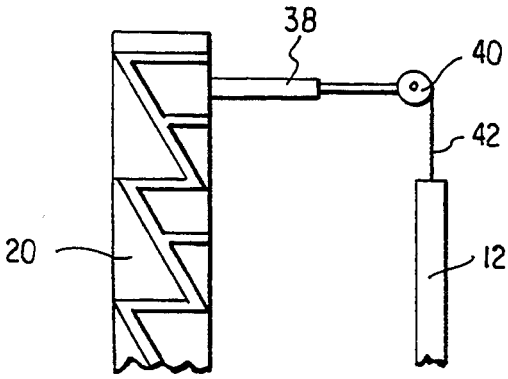

APPARATUS AND METHOD FOR REPAIR OF ROADWAY

This is a continuation of U.S. application Ser. No. 07/818, 882, filed Jan. 10, 1992 now abandoned.

TECHNICAL FIELD

This invention relates to the art of machines for repair of a roadway.

BACKGROUND

Roads which have been cut into side of a hill often suffer from a falling away of the embankment. This damage must be repaired by the creation of an artificial wall against which material can be placed to reform the roadway.

Presently, such repairs are extremely difficult, particularly on steep slopes, because of the necessity of drilling a hole for receiving a reinforcing rail. Drilling such a hole on a steep slope requires that a heavy piece of equipment be located on the slope in the area of the damage. This is quite time consuming and expensive.

Known devices for repair of damaged shoulders in a roadway are incapable of providing effective and efficient repair. In addition, known devices which are capable of drilling holes for receiving posts, or the like, are not useful for the environment which concerns this invention wherein the slope of the hill having the roadway is somewhat steep such that it is difficult to maneuver a drilling machine off of the roadway.

Devices which are known for drilling post holes are illustrated by U.S. Pat. Nos. 3,696,625 (Alexander); 4,809,788 (Nelson); 3,756,330 (Russell, Jr.); and 4,627,499 (McGee).

Known apparatus for earthworking are illustrated by U.S. Pat. Nos. 2,820,556 (Davis); 3,536,218 (Guinot); 3,851,776 (Leyrat); 4,734,006 (Krob, et al.); and 4,773,814 (Brocklebank, et al.)

SUMMARY OF THE INVENTION

In accordance with the invention, a machine is provided which is capable of being driven on a normal roadway and which carries a platform having mounted thereon a drilling rig and power unit for supplying power to the drilling rig. The power unit and drilling rig are located at opposite ends of a platform which is rotatable with respect to the base. The length of the platform is such that when it is rotated into an operating position, the mast of the drilling rig extends outwardly by a distance sufficient to permit a hole for a retaining rail to be drilled while the base remains on the undamaged portion of the roadway.

The preferred horizontal distance between the wheels of the base and the drilling bit when the mast is in an operative position, in the preferred embodiment, is greater than five feet and preferably about six feet.

The power unit acts as a counterbalance for the weight of the drilling rig because it is placed at the opposite end of the platform. Thus, when the drilling rig is rotated to be in an operative position, only minimal additional support need be provided.

The drilling rig is generally known in the art, and air is used to expel the cuttings from the drilled hole. The drill is preferably capable of cutting through layers of rock in addition to the soil, whereby the rail can be placed in the bedrock and receive additional support. Thus, the hole can be completely prepared for insertion of a rail by operation of the equipment by a single operator without requiring involvement of additional workers.

The mast which supports the drill is provided with an adjustable jib at its top, the jib having a pulley for receiving a cable. The cable is attached at one end to a winch mounted on the rotatable platform, while the other end of the cable is adapted to be attached to the rail which is to be inserted into the hole. After the hole has been drilled, the reinforcing rail is lifted by attachment of the cable to the top of the rail and operation of the winch. The platform is then rotated to place the reinforcing rail over the hole which has been drilled and the jib operated to place the rail directly over the hole for insertion of the rail into the hole.

BRIEF DESCRIPTION OF THE DRAWINGS

FIG. 1 is a front view of an apparatus in accordance with the invention.

FIG. 2 is a partial view of the mast and jib of the apparatus shown in FIG. 1.

DETAILED DESCRIPTION OF THE PREFERRED EMBODIMENT

With reference to FIG. 1, an apparatus in accordance with the invention comprises a base 2 which includes tires 4 and a driver's compartment 6. The base 2 is capable of being driven in one lane of a normal two-lane roadway 8.

As illustrated in FIG. 1, a part of the roadway 8 has fallen away at 10 and requires repair. Repair is accomplished by drilling a series of holes 14 in the ground far enough from the undamaged portion of the roadway that the roadway can be rebuilt by placement of steel rails 12 in the holes and by placing backfill 16 in the region between the undamaged roadway and the steel rails 12.

The apparatus of the invention is specifically designed to be supported by the undamaged portion of the roadway and to drill the holes 14. A platform 18 is rotatably mounted on the base 2 for rotation about a generally vertical axis through an angular range of at least 180°. A drilling rig, which includes a mast 20, a known drilling unit 22 which is movable within the mast to drill hole 14 in the ground, and an operator's compartment 24 are mounted at one end of the platform 18. A power unit 26 is mounted at the other end of the platform. The power unit preferably includes an internal combustion engine of substantial size (e.g., 290 hp) and is placed on the platform to provide a counterbalance to the drilling rig, which is placed at the opposite end of the platform.

A hydraulic support 28 is mounted to the front of the base and includes a foot 30 for engaging the ground and providing support for the base. Preferably, two additional hydraulic supports (not shown) are provided at the rear of the base. Use of these three supports allows the base to be stably positioned on roadways in any of a variety of conditions. A hydraulic support may also be placed beneath the power unit 26 to resist forces applied to the drilling head.

The power unit includes an air compressor which provides air to the center of the drilling unit 22 through hose 32 for expelling cuttings from the hole made by the drilling unit. This allows the hole 14 to be drilled and prepared for insertion of rail 12 without requiring a workman to be adjacent the hole. The compressor preferably provides an air flow of at least about 400 cfm.

The power unit is at the end of the platform 18 opposite the drilling mast 20 to counterbalance the mast. In the preferred embodiment, the weight of the power unit is supplemented by additional ballast comprising steel weights (not shown) weighing about 8200 pounds.

The dimensions of the platform are such that the distance 34 between a wheel 4 and the drilling unit 22 is at least five feet and preferably about six feet. This allows the base 2 to be parked on the undamaged part of the roadway 8 and the drilling unit rotated to a position such that the drilling head is located far enough from the undamaged portion of the roadway to allow proper rebuilding of the entire roadway.

FIG. 2 illustrates a top part of the mast 20 which has mounted thereto a hydraulic jib 38. The jib is of adjustable length and has a pulley 40 at the end remote from the mast for receiving a cable 42. One end of the cable can be attached to an end of a rail 12 while the other end is attached to a winch (not shown) mounted on the platform to lift the rail for placing it in the hole 14.

For transport, the platform is placed in an orientation rotated 90° from that shown in FIG. 1, and the mast 12 is pivoted to a position where it rests on the mast support 36. The apparatus is then driven to the location of the damaged roadway, the mast is raised, and the platform is rotated to the position shown in FIG. 1. The platform is capable of rotation in either direction such that the drilling unit can be placed on either side of the base to repair damage to the roadway on either side of the base. After the hydraulic supports 28 have been brought into engagement with the ground and the base levelled and stabilized, A hole 14 is drilled in the ground in the desired location by operation of the drilling unit 22. The cuttings are blown out of the hole, by air carried in the hose 32, while the drilling unit is operated whereby an empty hole is made.

Then, the platform is rotated to allow a rail 12 to be attached to the cable 42 and the winch is operated to lift the rail. The platform is rotated to the hole to bring the rail adjacent the hole, and the length of the jib 38 is adjusted to align the rail with the hole. The winch is then operated to lower the rail into the hole. After the rail has been placed in the hole completely, the cable is disconnected, and the process is repeated until an adequate barrier has been made by a series of rails. Backfill is then placed behind the barrier to rebuild the roadway.

Use of the device as described permits very efficient repair of roadways, particularly in areas having steep slopes. Modifications within the scope of the appended claims will be apparent to those of skill in the art.

I claim:

1. Apparatus for repair of a roadway embankment comprising movable base means having supporting wheels and capable of being driven on a roadway, platform means mounted on said base means and rotatable with respect to said base means about a generally vertical axis, drilling means at one end of said platform means for drilling a hole for receiving an elongate reinforcing rail, and power means at an opposite end of said platform for generating power for said drilling means and for counterbalancing the weight of said drilling means, wherein said drilling means comprises a drilling bit, a mast for supporting said drilling bit, and means for generating a flow of air to remove cuttings, and the length of said platform is such that the distance between the centerline of said drilling bit and the outer side of the closest supporting wheel is at least about five feet when said drilling bit is in an operative position, and further comprising jib means attached to said mast for engaging and maneuvering said rail and for placing said rail in a hole made by said drilling means, whereby said base means may be located on a damaged roadway, said drilling bit operated to drill said hole for receiving said reinforcing rail, and said jib means operated to place said rail in said hole.

2. Apparatus according to claim 1 wherein said jib means comprises an adjustable arm attached to said mast.

3. Apparatus according to claim 2 wherein said adjustable arm comprises a hydraulic cylinder for adjusting the length of said arm.

4. Apparatus according to claim 3 wherein said jib means further comprises a cable for attachment to said rail and a winch for winding said cable to raise or lower said rail.

5. A method for preparing a roadway for repair, said roadway having an undamaged portion and a collapsed shoulder portion, comprising providing a base capable of being driven on said undamaged portion, said base having a rotatable platform carrying a drilling means, rotating said platform with respect to said base to locate said drilling means over a desired location for installation of a reinforcing rail, said desired location being a sufficient distance from said undamaged portion to allow said collapsed shoulder to be rebuilt and supported by said reinforcing rail, operating said drilling means to drill a hole, and placing said reinforcing rail in said hole by attaching said rail to said drilling means and maneuvering said rail to place said rail in said hole.

6. A method according to claim 5 wherein said step of placing reinforcing rail in said hole comprises attaching a cable supported by said drilling rig to said reinforcing rail and lifting said rail by said cable.

7. A method according to claim 6 wherein said step of placing said reinforcing rail in said hole comprises adjusting the distance between said drilling means and said cable.

8. Apparatus for repair of a roadway embankment comprising movable base means capable of being driven on a roadway, platform means mounted on said base means and rotatable with respect to said base means about a generally vertical axis, drilling means at one end of said platform means for drilling a hole for receiving an elongate reinforcing rail, and power means at an opposite end of said platform for generating power for said drilling means and for counterbalancing the weight of said drilling means, wherein said drilling means includes a mast for supporting a drilling bit and further comprising jib means attached to said mast for engaging and maneuvering said rail and for placing said rail in a hole made by said drilling means, whereby said base means may be located on a damaged roadway, said drilling means operated to drill said hole for receiving said reinforcing rail, and said jib means operated to place said rail in said hole.

9. Apparatus according to claim 8 wherein said jib means comprises an arm of adjustable length.

10. Apparatus according to claim 8 further comprising means for housing an operator for operating said drilling and platform means, said means for housing being mounted on said platform adjacent said drilling means.

11. Apparatus according to claim 8 further comprising levelling means for extending between the ground and said base for providing adjustable vertical forces.

* * * * *